US010101020B2

(12) United States Patent
Hung

(10) Patent No.: US 10,101,020 B2
(45) Date of Patent: Oct. 16, 2018

(54) UNIFORMLY LUMINOUS FAN SHIELD STRUCTURE AND FAN HAVING THE SAME

(71) Applicant: SilverStone Technology Co., Ltd., New Taipei (TW)

(72) Inventor: Wei-Cheng Hung, New Taipei (TW)

(73) Assignee: SILVERSTONE TECHNOLOGY CO., LTD., New Taipei (TW)

( * ) Notice: Subject to any disclaimer, the term of this patent is extended or adjusted under 35 U.S.C. 154(b) by 117 days.

(21) Appl. No.: 15/433,089

(22) Filed: Feb. 15, 2017

(65) Prior Publication Data

US 2018/0231241 A1 Aug. 16, 2018

(51) Int. Cl.

| | |
|---|---|
| ***F21V 8/00*** | (2006.01) |
| ***F21V 33/00*** | (2006.01) |
| ***F21V 3/02*** | (2006.01) |
| ***F21V 23/00*** | (2015.01) |
| ***F21V 17/10*** | (2006.01) |
| ***F21V 19/00*** | (2006.01) |
| ***F04D 29/70*** | (2006.01) |
| ***F04D 29/52*** | (2006.01) |

(Continued)

(52) U.S. Cl.

CPC ..... *F21V 33/0096* (2013.01); *F04D 29/325* (2013.01); *F04D 29/522* (2013.01); *F04D 29/703* (2013.01); *F21V 3/02* (2013.01); *F21V 17/10* (2013.01); *F21V 19/003* (2013.01); *F21V 23/001* (2013.01); *F21Y 2103/33* (2016.08); *F21Y 2115/10* (2016.08)

(58) Field of Classification Search

CPC ..... F21V 33/0096; F21V 3/02; F21V 17/10; F21V 19/003; F21V 23/001; F04D 29/325; F04D 29/522; F04D 29/703

See application file for complete search history.

(56) References Cited

U.S. PATENT DOCUMENTS 6,790,003 B1 * 9/2004 Hu ..... F04D 25/0613 415/118
9,777,918 B1 * 10/2017 Wen ..... F21V 33/0096

(Continued)

FOREIGN PATENT DOCUMENTS

CN 201269203 Y 7/2009
CN 204498539 U 7/2015

(Continued)

OTHER PUBLICATIONS

Evaluation report of utility model patent dated Sep. 22, 2017 of the corresponding China application No. 201720024396.2.

(Continued)

*Primary Examiner* — Mary Ellen Bowman

(74) *Attorney, Agent, or Firm* — Chun-Ming Shih; HDLS IPR Services

(57) ABSTRACT

A uniformly luminous fan shield structure includes a light-transparent cover (10) and a light emitting diode (LED) module (30). The light-transparent cover (10) includes a central area (11) and a ring (12) around the central area (11). The ring (12) includes a groove (121). A side surface of the groove (121) includes light guide structures (125). The LED module (30) is accommodated in the groove (121). The LED module (30) includes LEDs (32), and each LED (32) illuminates toward each light guide structure (125) and the central area (11), so as to achieve uniform luminosity of the light-transparent cover (10).

20 Claims, 7 Drawing Sheets

(51) Int. Cl.

| | |
|---|---|
| ***F04D 29/32*** | (2006.01) |
| *F21Y 115/10* | (2016.01) |
| *F21Y 103/33* | (2016.01) |

(56) References Cited

U.S. PATENT DOCUMENTS

| | | | | |
|---|---|---|---|---|
| 2007/0248476 | A1* | 10/2007 | Lewis | F04D 25/0613 417/423.1 |
| 2015/0086336 | A1* | 3/2015 | Liu | F04D 29/005 415/121.2 |
| 2016/0154164 | A1* | 6/2016 | Lin | F21V 33/0096 362/96 |
| 2016/0169503 | A1* | 6/2016 | Chen | F21K 9/20 416/5 |
| 2018/0017725 | A1* | 1/2018 | Fang | F21V 33/0096 |
| 2018/0163960 | A1* | 6/2018 | Lin | F21V 33/0096 |
| 2018/0187689 | A1* | 7/2018 | Chen | F04D 27/004 |

FOREIGN PATENT DOCUMENTS

| | | | |
|---|---|---|---|
| CN | 205263735 | U | 5/2016 |
| CN | 205478440 | U | 8/2016 |
| CN | 205744608 | U | 11/2016 |
| CN | 106286347 | A | 1/2017 |
| DE | 202016104642 | U1 | 9/2016 |
| DE | 202016104642 | U1 | 10/2016 |

OTHER PUBLICATIONS

Database WPI Week 201710, Thomson Scientific, London, GB; AN 2017-04552H XP002772949-&CN106287457A (Chen Y), Jan. 4, 2017. *abstract* *Figs. 3, 8*.

Database WPI Week 201542, Thomson. Scientific, London, GB; AN 2015-35116B XP002772950,-&CN204261090U (Xiamen Comfort Health Technology Co., Ltd.), Apr. 15, 2015 *abstract* *Figs. 1-3*.

Search Report dated Aug. 22, 2017 of the corresponding European patent application.

* cited by examiner

UNIFORMLY LUMINOUS FAN SHIELD STRUCTURE AND FAN HAVING THE SAME

TECHNICAL FIELD

The present invention relates to a fan technique and, in particular, to a uniformly luminous fan shield structure and a fan having the same.

BACKGROUND

In engines, central processing units (CPUs), hard disk drives (HDDs), power supplies, computer housings, or other products, usually a heat dissipation fan is utilized for cooling so as to prevent damage caused by overheating. In order to increase a value of the heat dissipation fan, a light source is installed in the heat dissipation fan for decoration and fun.

However, in practice, the luminous heat dissipation fan has the following disadvantages. Due to the structure design, configuration and a light emitting direction of the light source is limited, so only a small area or a single dot in the fan can emit light.

Accordingly, the target of the present invention is to solve the above-mentioned problems, on the basis of which the present invention is accomplished.

SUMMARY

It is an object of the present invention to provide a uniformly luminous fan shield structure and a fan having the same. The light-transparent cover collaborates with the light emitting diode (LED) module to achieve uniform luminosity of the light-transparent cover.

Accordingly, the present invention provides a uniformly luminous fan shield structure which comprises a light-transparent cover and a light emitting diode module. The light-transparent cover includes a central area and a ring around the central area. The ring includes a groove. A side surface of the groove includes a plurality of light guide structures. The light emitting diode module is accommodated in the groove. The light emitting diode module includes a plurality of light emitting diodes. Each light emitting diode illuminates toward each light guide structure and the central area.

Accordingly, the present invention provides a fan having a fan shield structure. The fan has a uniformly luminous fan shield structure and a fan member. The fan shield structure includes a light-transparent cover and a light emitting diode module. The light-transparent cover includes a central area and a ring around the central area, the ring includes a groove, and a side surface of the groove includes a plurality of light guide structures. The light emitting diode module is accommodated in the groove, the light emitting diode module includes a plurality of light emitting diodes, each light emitting diode illuminates toward each light guide structure and the central area. On the fan member, the fan shield structure is disposed, and the fan member is arranged at one side of the fan shield structure.

The present invention further has the following functions. By using the light guide structure and light guide notches, the light emitted by each light emitting diode is uniformly distributed to most area of the light-transparent cover. The hexagonal substrate and the Y-shaped light guide supporter cover an overall circular surface, so that uniform luminosity is achieved.

BRIEF DESCRIPTION OF THE DRAWINGS

The disclosure will become more fully understood from the detailed description and the drawings given herein below for illustration only, and thus does not limit the disclosure, wherein.

DETAILED DESCRIPTION

Figure 1:
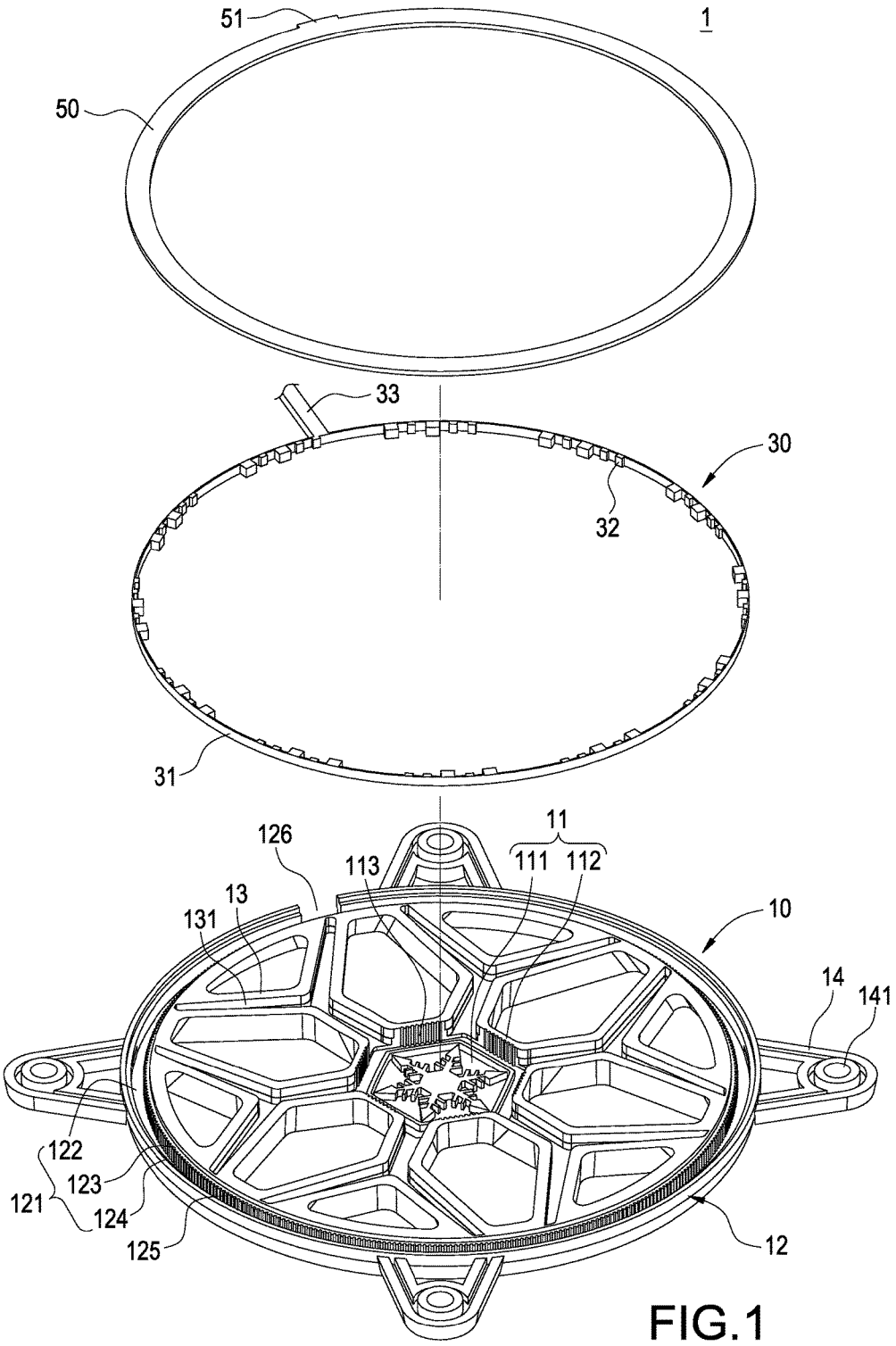
FIG. 1 is a perspective exploded view illustrating a fan shield structure according to the present invention.
Figure 2:
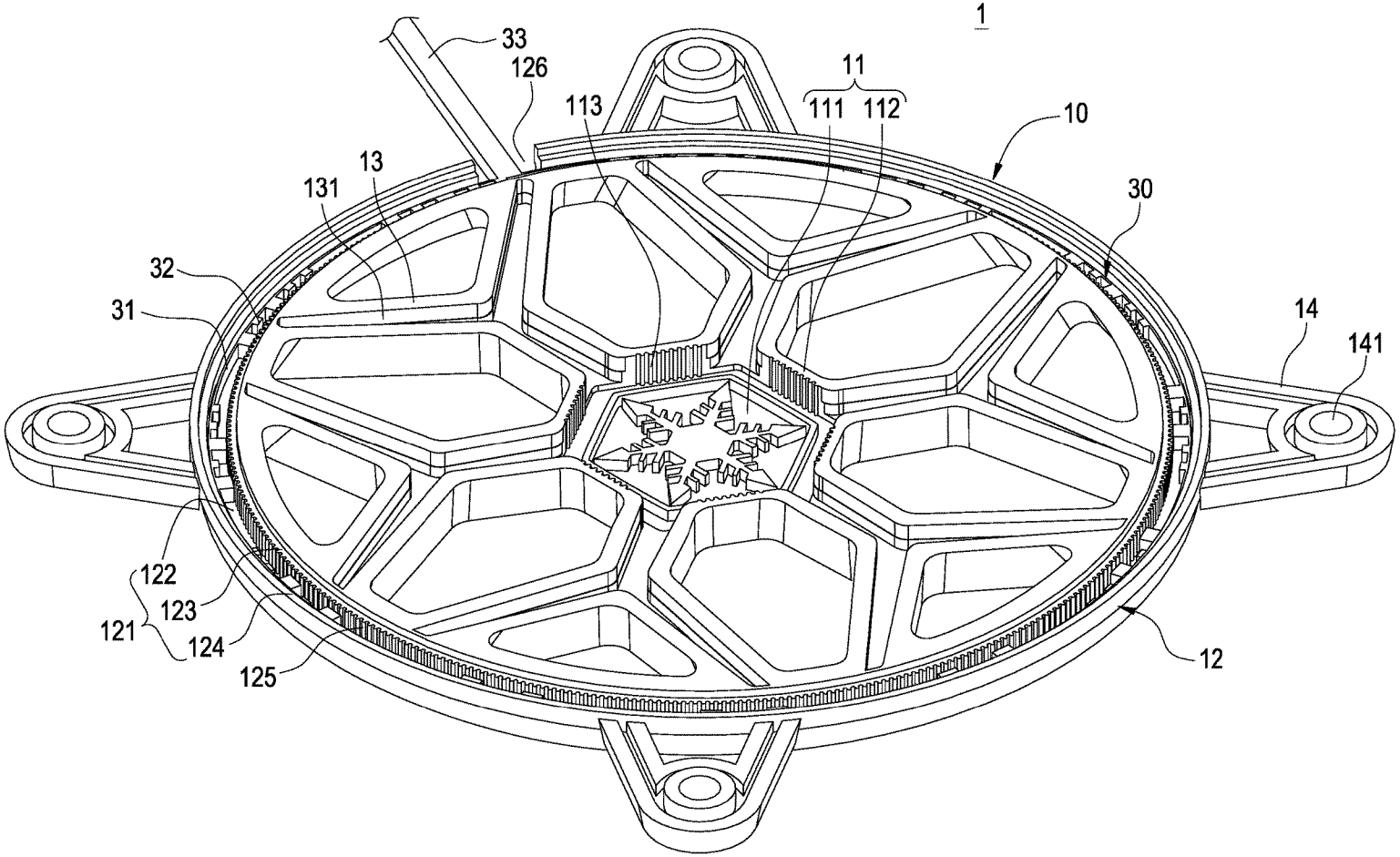
FIG. 2 is schematic view illustrating a light-transparent cover in combination with a light emitting diode module according to the present invention.
Figure 3:
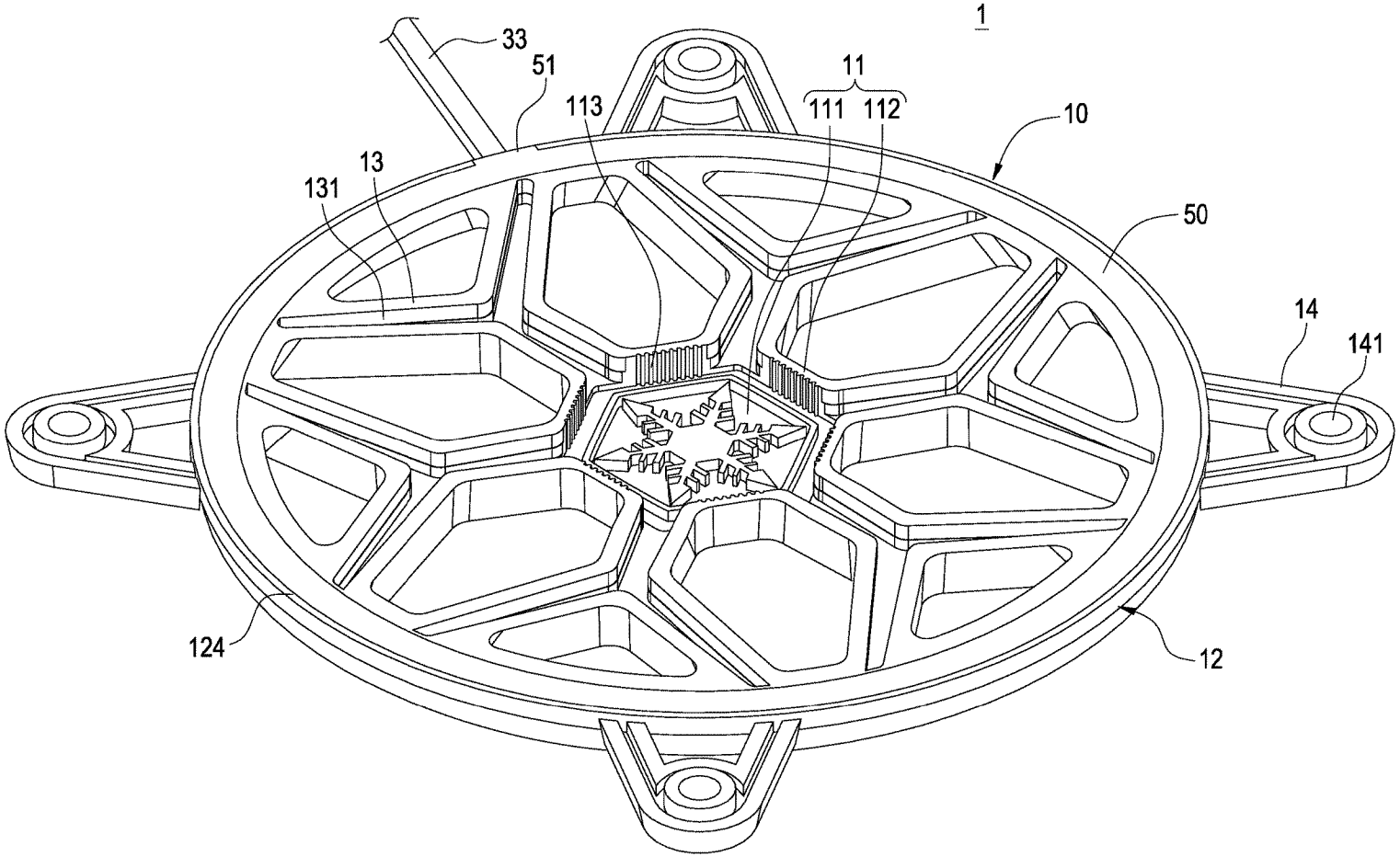
FIG. 3 is an assembled view of the fan shield structure.
Figure 4:
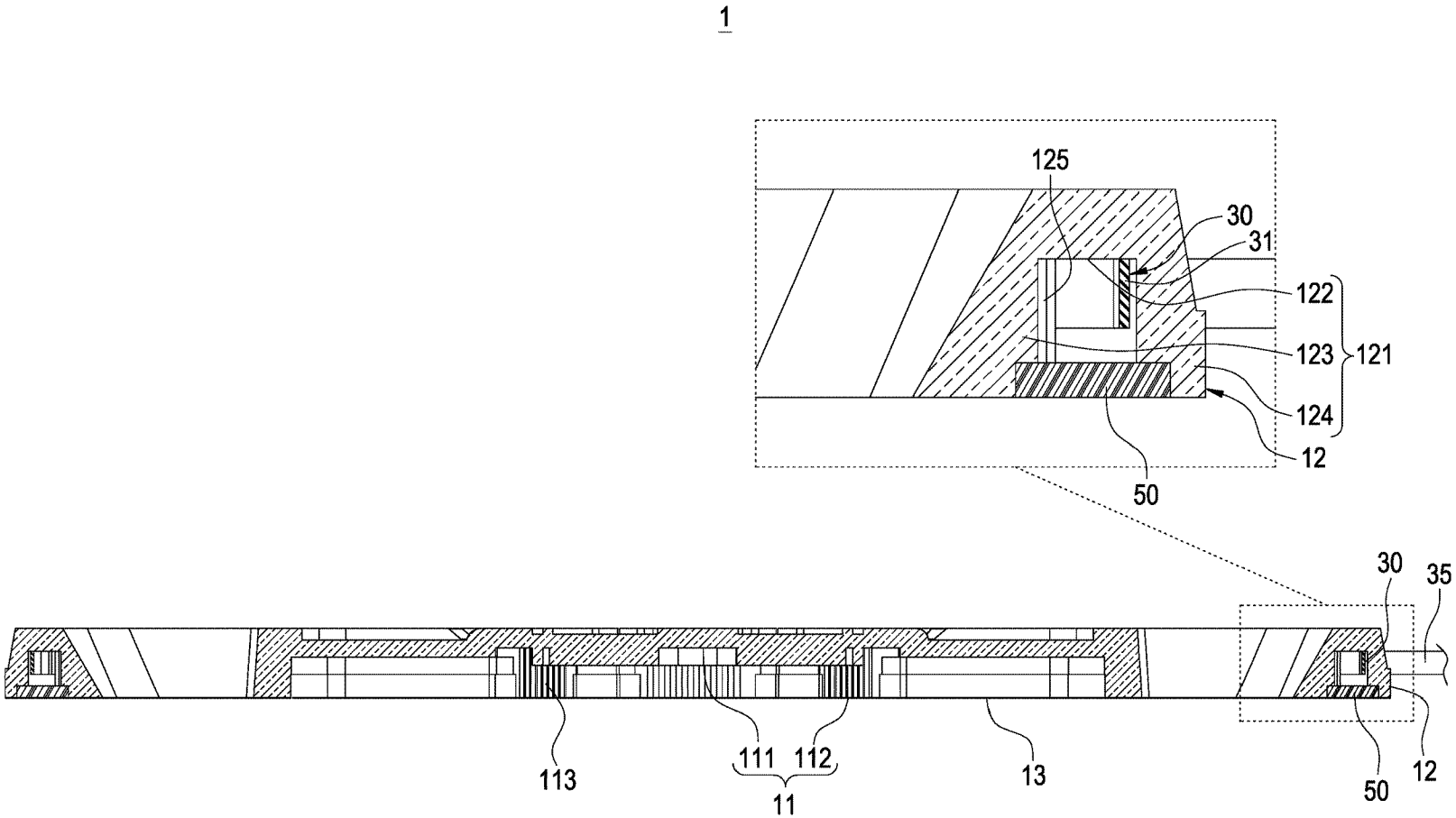
FIG. 4 is an assembled cross-sectional view illustrating the fan shield structure.
Figure 5:
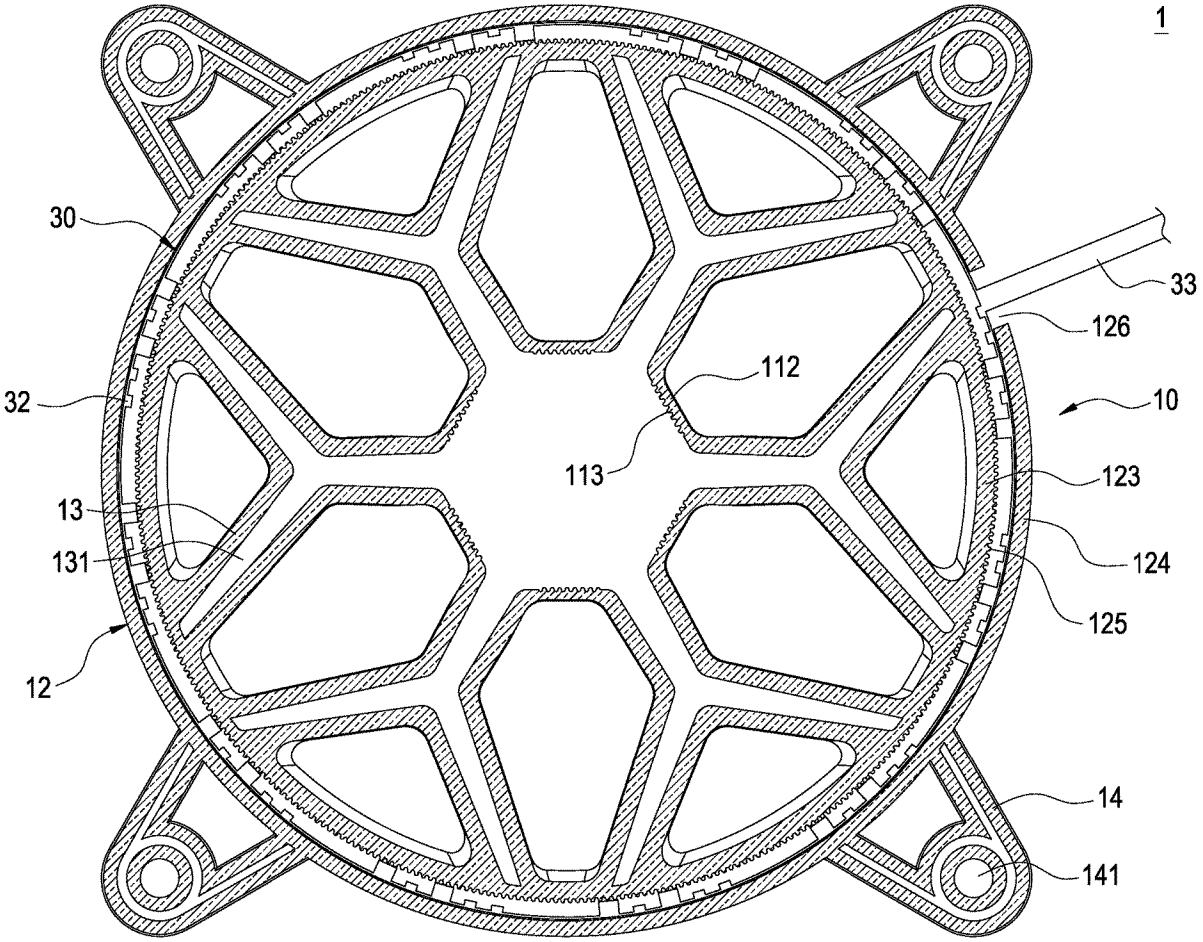
FIG. 5 is an assembled cross-sectional view taken along another direction illustrating the fan shield structure.

Detailed descriptions and technical contents of the present invention are illustrated below in conjunction with the accompany drawings. However, it is to be understood that the descriptions and the accompany drawings disclosed herein are merely illustrative and exemplary and not intended to limit the scope of the present invention.

Referring to FIGS. 1 to 5, the present invention provides a uniformly luminous fan shield structure. The fan shield structure 1 includes a light-transparent cover 10 and a light emitting diode module 30.

The light-transparent cover 10 can consist of polymethyl methacrylate (PMMA) resin. The light-transparent cover 10 has a central area 11 and a ring 12. The central area 11 includes a hexagonal substrate 111 and a plurality of standing plates 112 extending upwards from a periphery of the hexagonal substrate 111. A plurality of light guide notches 113 is disposed on an inner surface of each standing plate 112.

The ring 12 is a circle around the central area 11. A groove 121 is disposed inside the ring 12, and the groove 121 has a shape matching with a shape of the ring 12. The groove 121 is formed by a bottom plate 122 and by an inner side wall 123 and an outer side wall 124 connected to the bottom plate 122. The bottom plate 122, the inner side wall 123 and the outer side wall 124 are of round annular shape. A plurality of light guide structures 125 are formed on a surface of the inner side wall 123, and the light guide structure 125 is a longitudinal notch. The ring 12 includes a wire outlet opening 126 at one side of the outer side wall 124.

Furthermore, the central area 11 and the ring 12 are connected by means of a plurality of Y-shaped light guide supporters 13, a bottom end of each of the Y-shaped light guide supporters 13 is connected to a corresponding corner of the hexagonal substrate 111, a top end of each of the Y-shaped light guide supporters 13 is connected to an inner surface of the ring 12, and a Y-shaped channel 131 is disposed inside each of the Y-shaped light guide supporters 13. A plurality of connection elements 14, spaced apart at equal intervals, extend from an outer circumferential surface of the ring 12, and a top end of each of the connection elements 14 includes a hollow cylindrical pillar 141.

In the present embodiment, the light emitting diode module 30 is of round annular shape. The light emitting diode module 30 includes an annular circuit 31 and a plurality of light emitting diodes 32 disposed on an inner surface of the annular circuit 31. Each light emitting diode 32 is a red-green-blue (RGB) light emitting diode (LED). The annular circuit 31 is accommodated in the groove 121 of the ring 12. Each light emitting diode 32 illuminates toward each light guide structure 125 and the central area 11. By utilizing a controller (not illustrated), each light emitting diode 32 can emit light which may be continuous, intermittent, blinking, or in other forms. A wire 33 is electrically connected to one side of the annular circuit 31, and the wire 33 protrudes out of the ring 12 from the wire outlet opening 126.

Moreover, the uniformly luminous fan shield structure 1 further includes a press plate 50, and the press plate 50 is of round annular shape. The press plate 50 is disposed corresponding to the groove 121 and is connected to the ring 12 to thereby enclose the light emitting diode module 30 between the ring 12 and the press plate 50. An engagement block 51 extends from one side of the press plate 50, and the engagement block 51 is engaged with the wire outlet opening 126.

Figure 6:
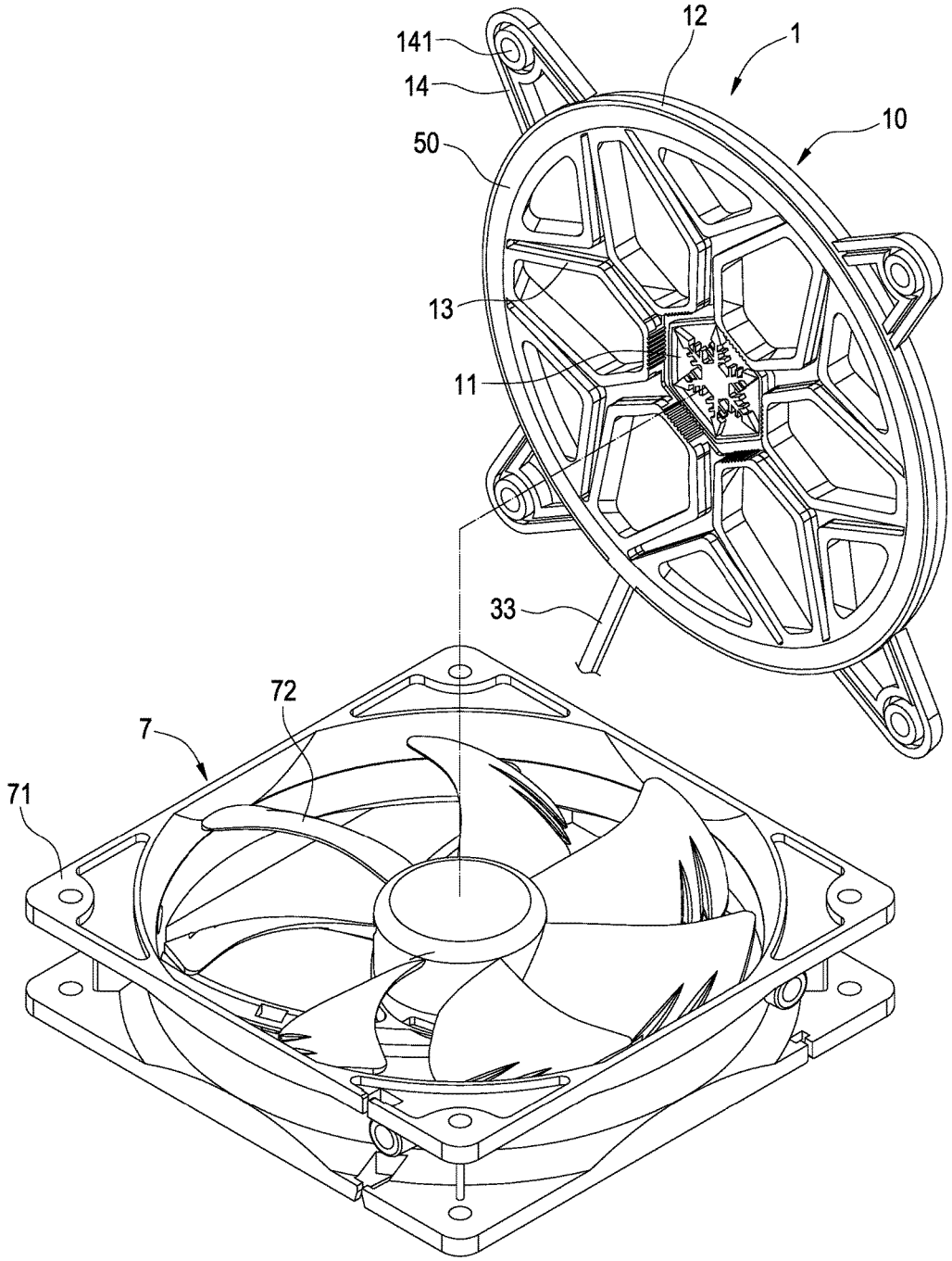
FIG. 6 is a perspective exploded view illustrating a fan having the fan shield structure according to the present invention.
Figure 7:
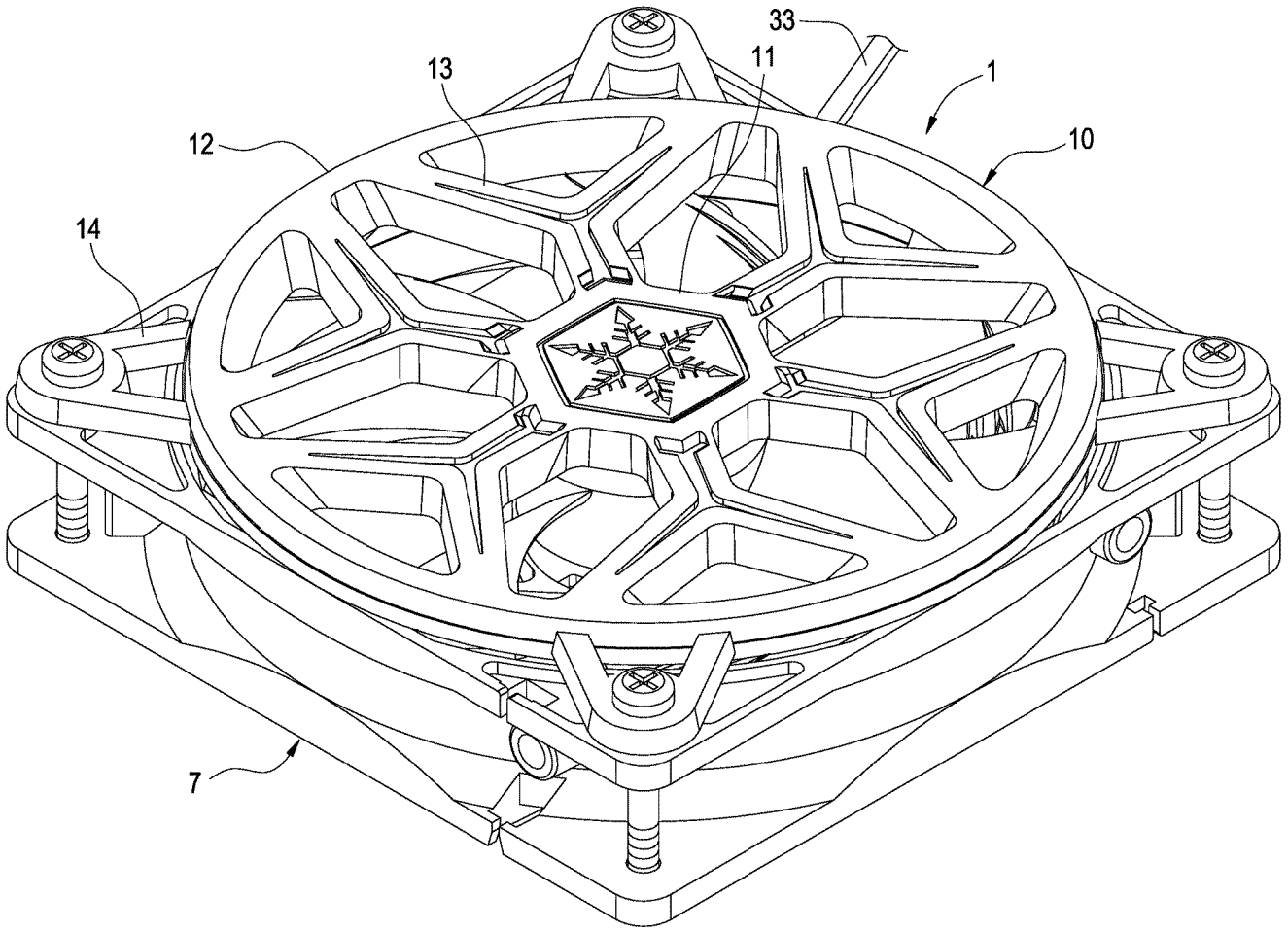
FIG. 7 is an assembled view showing the appearance of the fan having the fan shield structure.

Referring to FIGS. 6 and 7, the present invention further provides a fan having the fan shield structure. The fan includes the uniformly luminous fan shield structure 1 and a fan member 7. The fan member 7 includes a frame 71 and a propeller 72 installed inside the frame 71. The frame 71 is substantially square. Each connection element 14 is joined to each corner of the frame 71. A threaded fastening element like a bolt is inserted in the hollow cylindrical pillar 141 to fix the fan shield structure 1 at one side of the frame 71, and a center of the propeller is disposed corresponding to the central area 11.

In summary, the uniformly luminous fan shield structure and the fan having the same certainly can achieve anticipated objectives and solve the conventional defects. The present invention also has novelty and non-obviousness, so the present invention completely complies with the requirements of patentability. Therefore, a request to patent the present invention is filed pursuant to patent law. Examination is kindly requested, and allowance of the present application is solicited to protect the rights of the inventor.

What is claimed is:

1. A uniformly luminous fan shield structure (1), comprising:

a light-transparent cover (10) including a central area (11) and a ring (12) around the central area (11), the ring (12) including a groove (121), a side surface of the groove (121) including a plurality of light guide structures (125); and a light emitting diode module (30) accommodated in the groove (121), the light emitting diode module (30) including a plurality of light emitting diodes (32), each light emitting diode (32) illuminating toward each light guide structure (125) and the central area (11).

2. The uniformly luminous fan shield structure of claim 1, wherein the central area (11) includes a hexagonal substrate (111) and a plurality of standing plates (112) extending from a periphery of the hexagonal substrate (111).

3. The uniformly luminous fan shield structure of claim 2, wherein a plurality of light guide notches (113) are disposed on an inner surface of each of the standing plates (112).

4. The uniformly luminous fan shield structure of claim 2, wherein the central area (11) and the ring (12) are connected by means of a plurality of Y-shaped light guide supporters (13), one end of each of the Y-shaped light guide supporters (13) is connected to a corresponding corner of the hexagonal substrate (111), and the other end of each of the Y-shaped light guide supporters (13) is connected to the ring (12).

5. The uniformly luminous fan shield structure of claim 4, wherein a Y-shaped channel (131) is disposed inside each of the Y-shaped light guide supporters (13).

6. The uniformly luminous fan shield structure of claim 1, wherein the groove (121) is formed by a bottom plate (122) and by an inner side wall (123) and an outer side wall (124) connected to the bottom plate (122), and the bottom plate (122), the inner side wall (123) and the outer side wall (124) are of round annular shape.

7. The uniformly luminous fan shield structure of claim 6, wherein each of the light guide structures (125) is formed on a surface of the inner side wall (123), and the light guide structure (125) is a longitudinal notch.

8. The uniformly luminous fan shield structure of claim 1, wherein the light emitting diode module (30) further includes an annular circuit (31), each of the light emitting diodes (32) is disposed on the annular circuit (31), and the light emitting diode (32) is a red-green-blue (RGB) light emitting diode (LED).

9. The uniformly luminous fan shield structure of claim 8, wherein the light emitting diode module (30) further includes a wire (33), the wire (33) is electrically connected to the annular circuit (31), the ring (12) includes a wire outlet opening (126) at one side, and the wire (33) protrudes out of the ring (12) from the wire outlet opening (126).

10. The uniformly luminous fan shield structure of claim 1, further comprising a press plate (50), and the press plate (50) being disposed corresponding to the groove (121) and being connected to the ring (12) to thereby enclose the light emitting diode module (30) between the ring (12) and the press plate (50).

11. A fan having a fan shield structure, comprising:

a uniformly luminous fan shield structure (1), comprising:

a light-transparent cover (10) including a central area (11) and a ring (12) around the central area (11), the ring (12) including a groove (121), a side surface of the groove (121) including a plurality of light guide structures (125); and a light emitting diode module (30) accommodated in the groove (121), the light emitting diode module (30) including a plurality of light emitting diodes (32), each light emitting diode (32) illuminating toward each light guide structure (125) and the central area (11); and a fan member (7) on which the fan shield structure (1) is disposed, the fan member (7) being arranged at one side of the fan shield structure (1).

12. The fan having the fan shield structure of claim 11, wherein the fan member (7) includes a frame (71) and a propeller (72) installed inside the frame (71), a plurality of connection elements (14) extend from the ring (12), each of the connection elements (14) includes a hollow cylindrical pillar (141), each of the connection elements (14) is fastened to the fan member (7), and a threaded fastening element is inserted in the hollow cylindrical pillar (141) to fix the light-transparent cover (10) at one side of the frame (71).

13. The fan having the fan shield structure of claim 11, wherein the central area (11) includes a hexagonal substrate (111) and a plurality of standing plates (112) extending from a periphery of the hexagonal substrate (111), and a plurality of light guide notches (113) are disposed on an inner surface of each standing plate (112).

14. The fan having the fan shield structure of claim 13, wherein the central area (11) and the ring (12) are connected by means of a plurality of Y-shaped light guide supporters (13), one end of each of the Y-shaped light guide supporters (13) is connected to a corresponding corner of the hexagonal substrate (111), and the other end of each of the Y-shaped light guide supporters (13) is connected to the ring (12).

15. The fan having the fan shield structure of claim 14, wherein a Y-shaped channel (131) is disposed inside each of the Y-shaped light guide supporters (13).

16. The fan having the fan shield structure of claim 11, wherein the groove (121) is formed by a bottom plate (122) and by an inner side wall (123) and an outer side wall (124) connected to the bottom plate (122), and the bottom plate (122), the inner side wall (123) and the outer side wall (124) are of round annular shape.

17. The fan having the fan shield structure of claim 16, wherein each of the light guide structures (125) is formed on a surface of the inner side wall (123), and the light guide structure (125) is a longitudinal notch.

18. The fan having the fan shield structure of claim 11, wherein the light emitting diode module (30) further includes an annular circuit (31), each of the light emitting diodes (32) is disposed on the annular circuit (31), and the light emitting diode (32) is a red-green-blue (RGB) light emitting diode (LED).

19. The fan having the fan shield structure of claim 18, wherein the light emitting diode module (30) further includes a wire (33), the wire (33) is electrically connected to the annular circuit (31), the ring (12) includes a wire outlet opening (126) at one side, and the wire (33) protrudes out of the ring (12) from the wire outlet opening (126).

20. The fan having the fan shield structure of claim 11, further comprising a press plate (50), the press plate (50) being disposed corresponding to the groove (121) and being connected to the ring (12) to thereby enclose the light emitting diode module (30) between the ring (12) and the press plate (50).

* * * * *